United States Patent [19]

Brown

[11] 4,331,261

[45] May 25, 1982

[54] RETROFIT SINGLE-NEWSPAPER SECURITY DISPENSER

[76] Inventor: Kelly G. S. Brown, 4220 E. Florence St., Simi Valley, Calif. 96306

[21] Appl. No.: 182,440

[22] Filed: Aug. 29, 1980

[51] Int. Cl.[3] ..... B65H 1/08

[52] U.S. Cl. ..... 221/232; 221/241; 221/249; 221/274

[58] Field of Search ..... 221/232, 241, 249, 247, 221/270, 274, 248, 197, 198, 269

[56] References Cited

U.S. PATENT DOCUMENTS

| | | | |
|---|---|---|---|
| 2,501,434 | 3/1950 | Cameron | 221/241 X |
| 3,042,250 | 7/1962 | Watlington | 221/274 X |
| 3,063,597 | 11/1962 | Burdis et al. | 221/274 X |
| 3,114,475 | 12/1963 | Etes | 221/232 X |
| 4,273,256 | 6/1981 | Wenner | 221/232 X |
| 4,285,443 | 8/1981 | Winans | 221/232 X |

*Primary Examiner*—Allen N. Knowles
*Attorney, Agent, or Firm*—Allan M. Shapiro

[57] ABSTRACT

Single newspaper security dispenser structure retrofits within a presently conventional newspaper-dispensing rack. The dispenser includes a sliding table within a housing which fits and floats within the newspaper rack. The table rests on the top newspaper, slides out of the housing when the rack door is opened and draws a single newspaper out underneath with the table and through a front opening in the housing. The relative height of the dispenser table and housing, and the length of the paper-pulling tongue are adjustable in accordance with paper thickness.

19 Claims, 6 Drawing Figures

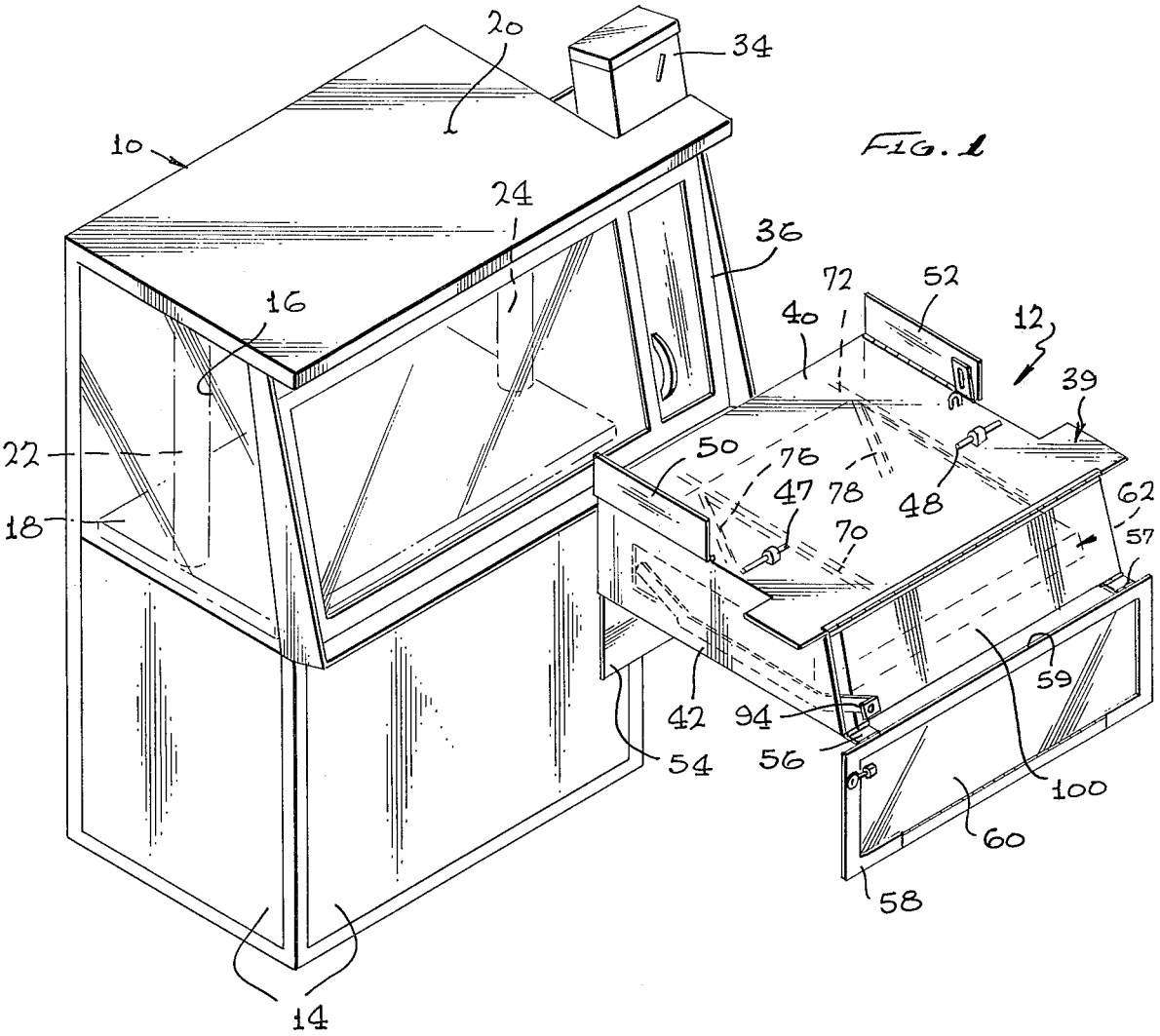
FIG. 1
FIG. 6
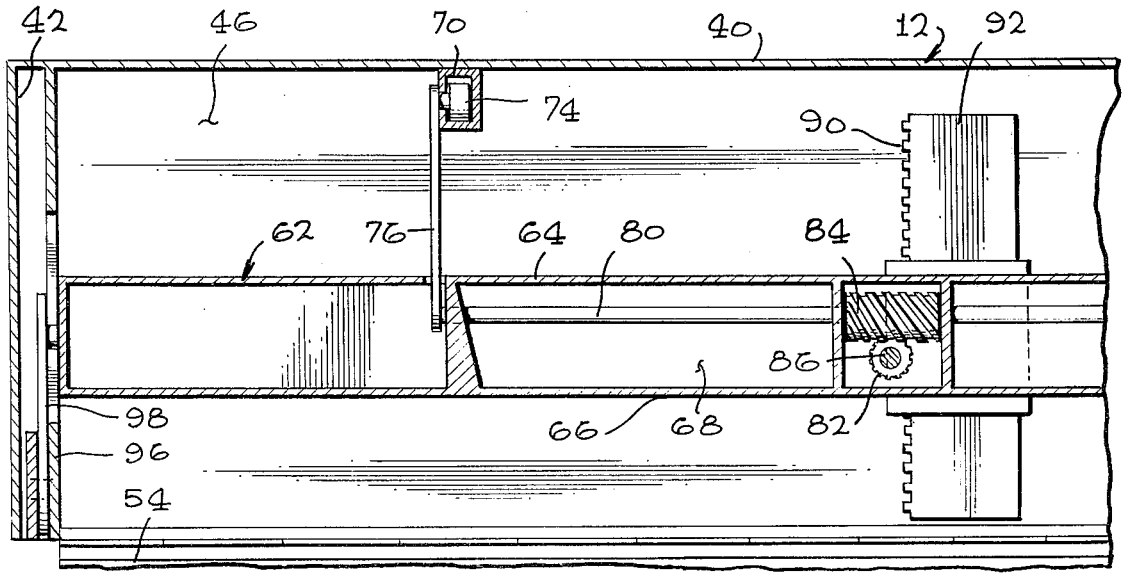

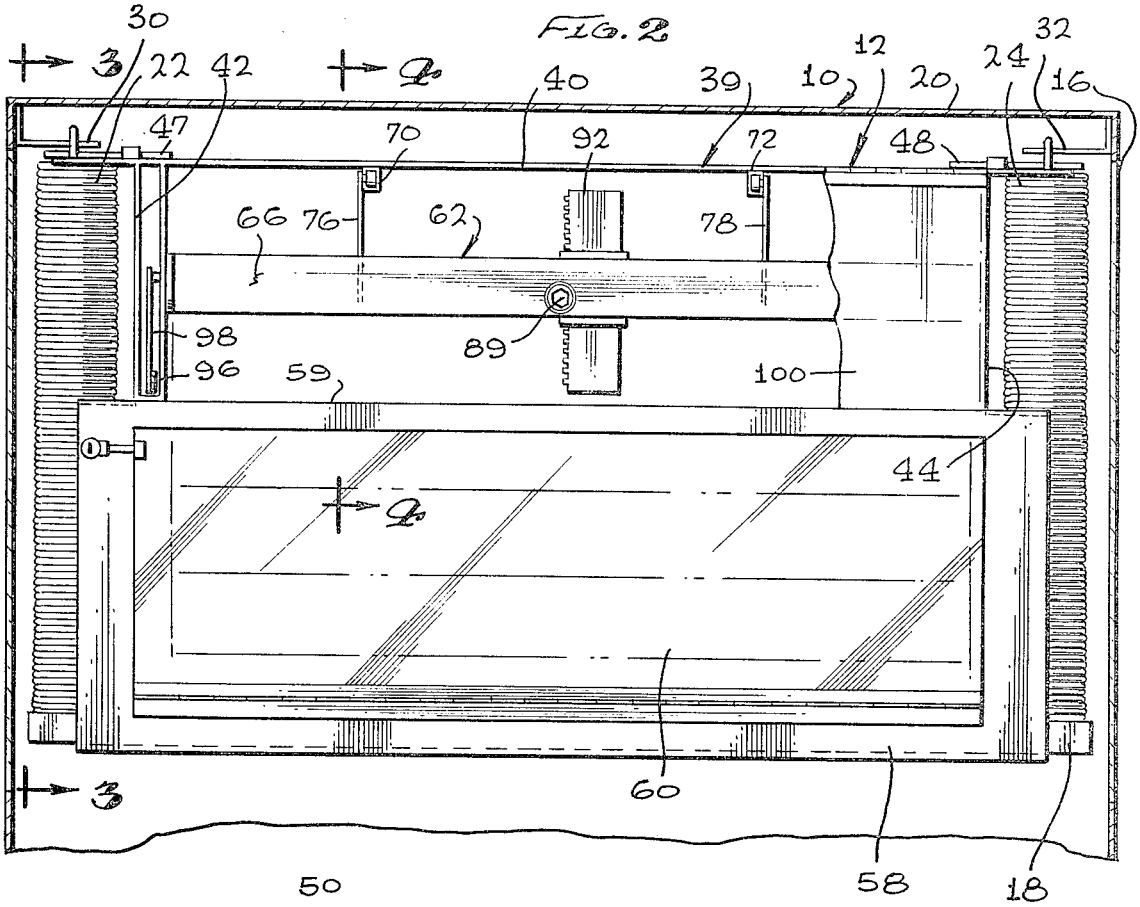
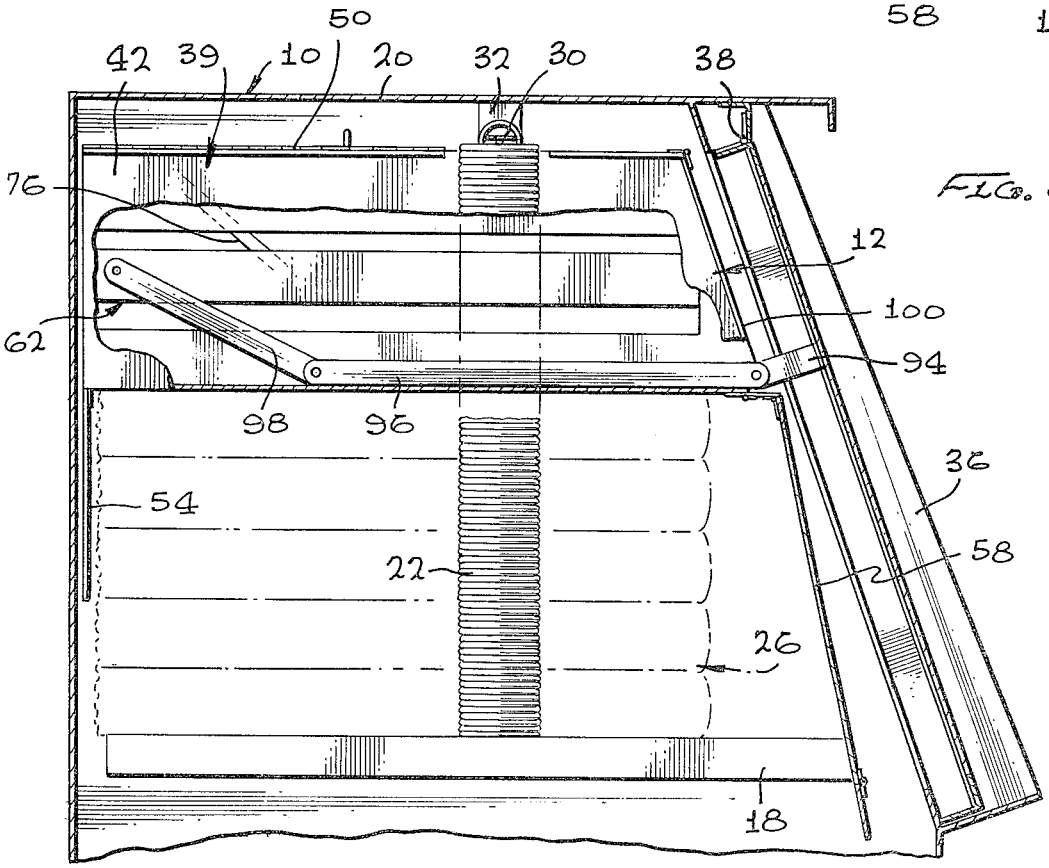
FIG. 3

10
12
26
28
32
36
38
40
44
46
48
54
56
58
59
62
64
66
68
70
76
80
82
84
86
88
89
90
92
100

RETROFIT SINGLE-NEWSPAPER SECURITY DISPENSER

BACKGROUND OF THE INVENTION

This invention is directed to a single newspaper dispenser, and particularly such a dispenser adapted to retrofit into existing newspaper racks.

In order to increase the numbers of sites at which the public can buy newspapers, newspaper racks have been developed. They normally are located in a place where large numbers of the public pass by, as on the sidewalk in a well-traveled area. As compared to an attended news vendor stand, a newspaper rack permits more such locations for purchasing a newspaper and does so at a lower overhead.

The conventional newspaper rack is a closed structure with an openable front door. When a coin is deposited, the door is opened by the buyer and a newspaper is withdrawn from the stack of papers therein by the buyer. In view of the fact that there is a plurality of papers available to the buyer's hand, he may take out more than one. Of course, if he only pays for one paper, the withdrawal of more than one is unprofitable to the newspaper publishing company. Thus, it is desirable to provide a structure wherein a single newspaper can be withdrawn. Furthermore, in view of the fact that there is a large number of such newspaper racks on the streets today, it is desirable to have a single newspaper dispenser which is capable of being retrofitted into the existing newspaper racks.

The prior art has recognized the problem of withdrawal of more than a single newspaper from today's conventional newspaper rack. The prior art recognizes that it is desirable for economic purposes to permit withdrawal, or cause dispensing of only a single newspaper for each payment. However, the prior art solution to this problem has been to create an entirely new and specially designed newspaper-vending machine. For example, Cameron U.S. Pat. No. 2,501,434 discloses a stack of newspapers raised by springs against a pusher plate which has a rear hook engaging over the rear edge of the newspaper so that forward movement of the pusher plate causes a single newspaper to be dispensed through a narrow slot. Knickerbocker U.S. Pat. No. 3,747,733 discloses a newspaper-dispensing machine wherein a single newspaper is manually withdrawn from the top of the stack, with the slot being sufficiently narrow so that only one newspaper can be reached.

Gordon U.S. Pat. No. 4,085,864 describes a newspaper-vending machine wherein the bottom newspaper on the stack of newspapers is withdrawn by engaging it with a series of teeth to drag the newspaper forward through a vending slot. Hawks U.S. Pat. No. 2,612,426 discloses a newspaper-vending machine which uses sharpened points in a feed starter mechanism to engage the top paper of the stacked newspapers, and the feed starter moves the top newspaper to engage between a pair of rollers which then feed the top paper out through a chute slot. Watlington U.S. Pat. No. 3,042,250 uses pivoted dispensing fingers with penetrating points for engaging and moving the topmost paper into a vending chute in his newspaper-vending apparatus. From this background, it is clear that the prior art has not achieved the most desirable objective of being able to retrofit existing newspaper racks. Furthermore, the prior art has not solved the problem of dispensing a single newspaper from a stack wherein from day-to-day the newspapers in the stack will be of different thickness and to dispense the newspapers without damage thereto.

SUMMARY OF THE INVENTION

In order to aid in the understanding of this invention, it can be stated in essentially summary form that it is directed to a single newspaper dispenser, and particularly a dispenser which is adapted to be retrofitted into an existing newspaper rack. The single newspaper dispenser has a table therein which rests on the top newspaper in a stack, which has adjustable height position with respect to the bottom of an exit slot, and which has a tongue thereon of adjustable extension so that, as the table is moved forward, a single newspaper is drawn from the top of the stack and dispensed.

It is thus an object of this invention to provide a single newspaper dispenser which can be retrofitted into existing newspaper racks so that existing newspaper racks are then capable of protecting the bulk of their contained newspapers. It is a further object to provide a single newspaper dispenser which is capable of dispensing a single newspaper from a rack independent of the thickness of the newspaper in that particular day's issue.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is an isometric view of the modern-day newspaper rack of this invention, shown with the single newspaper dispenser of this invention associated therewith, and ready for insertion to convert the newspaper rack into a single newspaper-dispensing newspaper rack.

FIG. 2 is a front view of the upper portion of a conventional newspaper rack, with parts broken away and parts taken in section, showing the single newspaper dispenser of this invention positioned therein.

FIG. 3 is a section taken generally along the line 3—3 of FIG. 2.

FIG. 6 is a rearwardly directed section, with parts broken away, as seen generally along the line 6—6 of FIG. 4.

DESCRIPTION OF THE PREFERRED EMBODIMENT

Figures 4, 5:
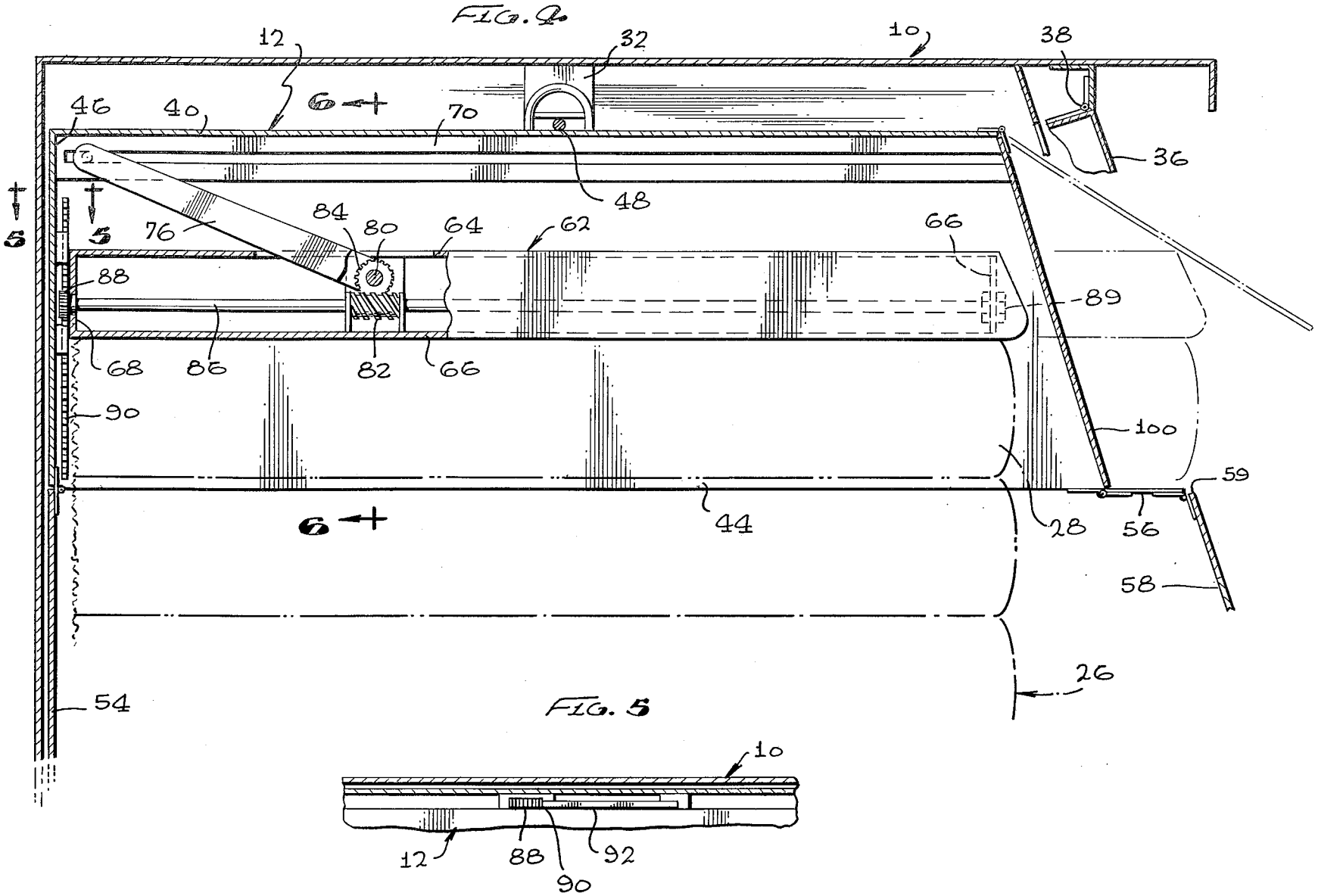
FIG. 4 is an enlarged section taken generally along the line 4—4 of FIG. 2, with parts broken away.
FIG. 5 is a view downward onto the newspaper withdrawal tongue, as seen generally along the line 5—5 of FIG. 4, with parts broken away.

The conventional newspaper rack 10 is illustrated in FIG. 1. The single newspaper dispenser 12 is illustrated in association therewith for positioning therein to retrofit the newspaper rack 10 as a single newspaper-dispensing rack. The conventional newspaper rack 10 is a closed housing which usually has solid lower panels 14 therearound and transparent upper panels 16 therearound. Rack table 18 within the newspaper rack housing is supported from the top 20 by a pair of springs 22 and 24. The springs are of such tension and such rate so as to raise any stack of newspapers positioned on rack table 18 upward so that the upper newspaper is in a conveniently raised position underneath top 20. A stack 26 is shown in FIGS. 3 and 4 with the uppermost newspaper 28 being positioned on top of the stack. As is seen in FIGS. 2 and 3, springs 22 and 24 are secured at their upper ends on spring hangers 30 and 32 secured in newspaper rack 10 just below the top 20 thereof.

Newspaper rack 10 is provided with coil acceptor 34, see FIG. 1. Coin acceptor 34 can receive coins from the purchaser, and when the appropriate coins are deposited, rack door 36 can be manually opened and pivoted around a top horizontal hinge axis 38. This much is conventional structure and describes a common type of newspaper rack which is commonly used to dispense today's papers. In the structure, it is clear that a person can deposit coins in coin acceptor 34, open rack door 36 and remove as many newspapers as he wishes. From the viewpoint of the agency responsible for the sales of the newspapers, it is desirable that he remove only one such paper. Newspaper dispenser 12 is provided for that purpose.

As seen in the several Figures, newspaper dispenser 12 is in the form of a housing 39 having top 40, sides 42 and 44 and back 46. The housing 39 is dimensioned so that it fits between and can be inserted between springs 22 and 24 with its top 40 adjacent the top of the springs, see FIG. 2. Sliding bolts 47 and 48 are mounted on the top 40 to engage in the spring loops where they engage over spring hangers 30 and 32, to support the housing 39 within the upper portion of newspaper rack 10; this shell supporting engagement of the bolts 47 and 48 occurs only during the newspaper loading stage of operation, as described more fully later. Hinge panels 50 and 52, see FIG. 1, are engaged behind the spring hanger. The hinge panels are locked down to prevent withdrawal of the housing 39 from the newspaper rack during its floating status. The shell has a hinged lower back 54 which extends down behind the stack 26 of newspapers. It is hinged to permit the dispenser 12 to be inserted into the upper front of the newspaper rack 10 when the door 36 is opened. Housing 39 floats around the stack of newspapers and prevents access to them.

Front plates 56 and 57, see FIGS. 1 and 4, are fixed to extend forwardly from sides 42 and 44. Front lower plate 58 is fixed to plates 56 and 57. Front lower plate 58 is fixed at an angle so that its lower portion extends forward. In this position it is in front of rack table 18, see FIG. 3. The top edge 59 of plate 58 serves as the bottom, of the slot, above which the newspaper is dispensed. The front lower plate extends downward inside the housing of rack 10 below the opening of door 36 to prevent access to newspapers within rack 10 below dispenser 12. Front lower plate 58 has a hinged door 60 therein which is lockable in the closed position to permit access to the stack of newspapers so that more papers can be loaded into the rack. This is the extent of the housing which is the relatively fixed structure of the newspaper dispenser 12.

Table 62 is a built-up structure having a top 64, bottom 66 as well as a front and a back 68. The bottom 66 of table 62 rests on the top of the top newspaper 28 to support table 62. Roller guide tracks 70 and 72 are fitted onto top 40, and within them engage rollers for the support of table 62. Roller 74 engages in track 70 and is supported on support arm 76, see FIG. 6. A similar support arm 78 carries a roller in the other roller track, see FIG. 2. As is seen in FIG. 4, the support arms are mounted in table 62 so that the arms serve as interconnection between the table and the relatively fixed housing. The housing 39 is thus supported by the table on the support arms.

The arms are pivoted on axis 80, and the arms are rotatable around the axis by means of a worm 82 engaged in worm wheel 84 mounted on the arm support shaft. Adjustment control shaft 86 extends to the front of table 62 and is accessible thereat by means of a key compatible with keyhole 89 see FIG. 2. By this means, support arms 76 and 78 can be rotated to control the height of the housing with respect to table 62.

Also mounted on control shaft 86 is pinion 88, see FIG. 4, which engages in a rack 90 on the side of newspaper-engaging tongue 92, see FIG. 6. This structure is arranged so that, when adjustment control shaft 86 is moved to lower the housing 39, then tongue 92 is moved downwardly with respect to the table so that the lower edge of the tongue remains at substantially constant distance below top 40 and thus above front plate 56. In the preferred embodiment the bottom of tongue 92 is $\frac{1}{4}''$ above the level of plate edge 59, and this dimension is substantially constant. Lowering housing 39 with respect to table 62 increases the distance between the bottom 66 of table 62 and front plate edge 59 to dispense single issues of thicker newspapers. Raising housing 39 with respect to table 62 decreases the difference between the table bottom 66 and front plate edge 59 for dispensing of one issue of a thinner newspaper. The height of the housing 39 is adjusted so that the distance from the bottom 66 of the table to front plate edge 59 is exactly or slightly greater than the thickness of the newspapers in stack 26, see FIG. 5. Raising housing 39 also moves tongue 92 upwards with respect to table 62. It is thus seen that moving the table 62 outward, out of the fixed housing 39 of dispenser 12, causes the tongue 92 to engage behind the topmost newspaper 28 and thrust it out above front plate edge 59 as table 62 is moved forward.

Table 62 is moved forward by means of bracket 94 and links 96 and 98, see FIG. 3. Bracket 94 is fixed to the inside of rack door 36, and links 96 and 98 are pivoted to each other, to bracket 94 and to the side of table 62, see FIGS. 3 and 6. By this construction, when door 36 is raised, the links pull table 62 forward to dispense a single newspaper. The newspaper 28 is pulled off of the stack 26 by means of tongue 92 and is thrust out of the front, above front plate edge 59 and below table 62. It is thus manually engageable to the buyer. Hinged inner front door 100 is hinged at its top and is swung open by means of the outwardly moving table 62. Inner front door 10 serves as an additional protection of the stored newspapers against the local weather and also inhibits entry of the user's hands into the area above table 62 to help protect the user against the mechanism.

The entire newspaper dispenser 12 floats within rack 10, and is supported on the stack 26 of newspapers. when top newspaper 28 is dispensed, the rack table 18 rises on its springs to continue to support dispenser 12 in the upper part of rack 10.

When the newspaper rack 10 with its dispenser 12 is to be serviced, the newspaper sales agent raises the floating shell and locks it in the raised position by engaging sliding bolts 47 and 48 into the spring hangers, unlocks door 60, removes the day-old newspapers, presses down table 18, and places the new newspapers on table 18. When the proper quantity has been inserted, the door 60 is again locked to prevent unauthorized access to them. The agency man inserts a key into keyhole 89 and adjusts the height of housing 39 and the extension of rack 92 appropriately for the thickness of the newspaper. The height is such that a single newspaper can be dispensed between the bottom 66 of table 62 and the top of front plate edge 59, which is defined as the exit slot for the dispensed paper. At the same time, tongue 92 is extended so that it does not quite reach down below surface 66 the thickness of one newspaper. The agency man usually removes the coinage from coin acceptor 34, unlocks the housing by removing bolts 47 and 48 and the newspaper rack 10 with its dispenser 12 is ready for use by the public. As previously indicated, a coin is placed in coin acceptor 34, door 36 is manually pulled open, and with that action, table 62 is pulled forward to draw the top paper from the top of the stack without damage to the paper. The single dispensed newspaper is grasped by the buyer. No other newspapers are accessible to him. When he closes the door 36 into the locked position, only then does table 62 return to its rearward position shown in FIG. 4, and the tongue 92 hence engages behind the next newspaper in the stack for dispensing to the next buyer.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A single newspaper dispenser for positioning in a newspaper rack having a door so that, upon each opening of the door, a single newspaper is dispensed, the newspaper rack having a table therein for the support of a stack of newspapers, said single newspaper dispenser comprising:

a relatively stationary housing for positioning within the newspaper rack, said housing having guide tracks therein;

a table movably mounted within said housing for movement from a rest position where it is positioned within the newspaper rack to an extended position wherein it extends partly from the newspaper rack;

a downwardly directed tongue on said movable table adjacent the rear thereof for engagement behind the top newspaper on a stack of newspapers within the newspaper rack so that as said table moves from its rest position to its extended position it draws the top newspaper from the stack of newspapers to dispense a single newspaper from the newspaper rack.

2. The single newspaper dispenser of claim 1 wherein said housing has a plate thereon spaced below said movable table so that the newspaper is dispensed above said plate as said table draws a newspaper forward from the stack for dispensing.

3. The newspaper dispenser of claim 2 wherein said table is adjustable with respect to said plate so that said table can be adjusted to dispense single newspapers of selected thickness between said plate and said table.

4. The single newspaper dispenser of claim 3 in combination with a newspaper rack so that said single newspaper dispenser dispenses a single newspaper from said rack upon actuation.

5. The single newspaper dispenser of claim 4 wherein said table is for positioning on the top newspaper in a stack in said rack and said housing is supported on said table and floats around the stack of newspapers.

6. The combination of claim 4 wherein said newspaper rack has a door thereon for access to newspapers therein and said movable table is connected to said door so that as said door is opened said table is moved and a single newspaper is dispensed.

7. The single newspaper dispenser of claim 3 wherein said tongue is adjustably mounted on said table so that the extent that said tongue extends down from said table can be adjusted in accordance with the thickness of a newspaper to be dispensed.

8. The single newspaper dispenser of claim 7 wherein said adjustment for the height of said movable table with respect to said plate is connected to said tongue to adjust the amount of said tongue extends downwardly from said table at the same time the distance between said table and said plate is adjusted.

9. The single newspaper dispenser of claim 8 in combination with a newspaper rack so that said single newspaper dispenser dispenses a single newspaper from said rack upon actuation.

10. The single newspaper dispenser of claim 9 wherein said table is for positioning on the top newspaper in a stack in said rack and said housing is supported on said table and floats around the stack of newspapers.

11. The combination of claim 10 wherein said newspaper rack has a door thereon for access to newspapers therein and said movable table is connected to said door so that as said door is opened said table is moved and a single newspaper is dispensed.

12. The combination of claim 11 wherein said newspaper rack has spring hangers therein adjacent the top thereof, with extension springs hanging from said spring hangers and a rack table supported by said extension springs so that said rack table can carry a stack of newspapers thereon and resiliently urge the newspapers upward so that the topmost newspaper is in engagement under said sliding table to support said dispenser and so that the topmost newspaper is dispensed from the stack by movement of said sliding table.

13. The combination of claim 12 further including detachable attachment means so that said housing of said single newspaper dispenser can be temporarily supported within said newspaper rack on said spring hangers during servicing.

14. A single newspaper dispenser for positioning within a newspaper rack which has a plurality of newspapers stacked therein and urged upwardly therein, and has a door for access to the newspapers, said single newspaper dispenser having a housing for positioning within the newspaper rack for containment therein;

said housing having at least two guide tracks therein oriented in a direction toward the door opening in the newspaper rack;

a front plate on said housing extending transversely thereof to define a single newspaper-dispensing opening below said front plate;

a movable table in said housing, said table being for support on a stack of newspapers and having support arms thereon, said support arms engaging in said tracks in said housing for supporting said housing and so that said table is guided for motion toward and away from the door opening of the newspaper rack;

said arms being adjustable so that the position of said front plate with respect to said sliding table is adjustable in accordance with the thickness of a single newspaper to be dispensed; and an engaging tongue depending from said sliding table, said tongue being adjustable in accordance with the thickness of a single newspaper to be dispensed so that when the sliding table is drawn forward in a direction out of the door opening of the newspaper rack, said tongue engages on the top newspaper in a stack of newspapers under said table and said table draws the single topmost paper from the stack over said front plate and out of the door opening to dispense a single newspaper.

15. The single newspaper dispenser of claim 14 wherein said front plate height adjustment and said tongue extension length adjustment are connected together so that as said front plate is raised toward said table said tongue is retracted upward toward said sliding table.

16. The single newspaper dispenser of claim 15 wherein an adjustment control shaft extends to the front of said sliding table to permit access thereto from the front of the newspaper rack, said adjustment control shaft being connected to said support arms and to said tongue so that as said shaft is adjusted said arm and said tongue are adjusted.

17. The single newspaper dispenser of claim 16 wherein said support arm is a rotating arm and is rotated by said control shaft and said tongue has a rack thereon engaged by a pinion on said adjustment control shaft so that said support arm is rotated and said tongue is moved with respect to said table during rotation of said adjustment control shaft.

18. The single newspaper dispenser of claim 17 in combination with a newspaper rack so that said single newspaper dispenser dispenses a single newspaper from said rack upon actuation.

19. The combination of claim 18 wherein said newspaper rack has a door thereon for access to newspapers therein and said movable table is connected to said door so that as said door is opened said table is moved and a single newspaper is dispensed.

* * * * *